US007357348B2

(12) United States Patent
Kananen

(10) Patent No.: US 7,357,348 B2
(45) Date of Patent: Apr. 15, 2008

(54) DISPENSER APPARATUS WITH DRIVE MECHANISM

(75) Inventor: Daniel C. Kananen, Green Bay, WI (US)

(73) Assignee: Alwin Manufacturing Co., Inc., Green Bay, WI (US)

( * ) Notice: Subject to any disclaimer, the term of this patent is extended or adjusted under 35 U.S.C. 154(b) by 29 days.

(21) Appl. No.: 11/432,179

(22) Filed: May 11, 2006

(65) Prior Publication Data

US 2006/0266784 A1 Nov. 30, 2006

Related U.S. Application Data

(60) Provisional application No. 60/681,241, filed on May 13, 2005.

(51) Int. Cl.
*B65H 49/34* (2006.01)

(52) U.S. Cl. ..... 242/564.2

(58) Field of Classification Search ..... 242/564, 242/564.1, 564.2, 579, 580
See application file for complete search history.

(56) References Cited

U.S. PATENT DOCUMENTS 2,957,636 A * 10/1960 Lesavoy ..... 242/564.2
4,122,738 A 10/1978 Granger
4,188,844 A 2/1980 DeLuca
4,213,363 A 7/1980 Granger
4,307,639 A 12/1981 DeLuca
4,404,880 A 9/1983 DeLuca
4,432,261 A 2/1984 DeLuca
4,441,392 A 4/1984 DeLuca
4,621,755 A 11/1986 Granger
4,635,837 A 1/1987 Granger
4,712,461 A 12/1987 Rasmussen
5,048,386 A 9/1991 DeLuca et al.
5,294,192 A * 3/1994 Omdoll et al.
5,441,189 A 8/1995 Formon et al.
5,937,718 A 8/1999 Granger
5,979,822 A 11/1999 Morand et al.
6,112,631 A 9/2000 VanAlstine
6,224,010 B1 5/2001 Morand
6,237,871 B1 * 5/2001 Morand et al. ..... 242/564.2
6,314,850 B1 11/2001 Morand
6,446,901 B1 9/2002 Haen et al.

(Continued)

FOREIGN PATENT DOCUMENTS

CA 2439918 A1 9/2002

(Continued)

OTHER PUBLICATIONS

Perrin Manufacturing Company Towel Dispenser chassis (2 photographs). Date: Nov. 16, 2004.

*Primary Examiner*—William A. Rivera
(74) *Attorney, Agent, or Firm*—Jansson Shupe & Munger Ltd.

(57) ABSTRACT

Apparatus and methods for dispensing sheet material from a sheet material dispenser are described. A drive mechanism powered at least in part by one or more springs discharges sheet material from the dispenser. A diverter redirects at least one of the springs enabling use of a relatively longer spring in a more compact and space-efficient dispenser housing. The dispenser may include a cutting mechanism powered at least in part by the one or more springs.

31 Claims, 10 Drawing Sheets

U.S. PATENT DOCUMENTS

| | | | |
|---|---|---|---|
| 6,553,879 | B2 | 4/2003 | Morand |
| 6,684,751 | B2 | 2/2004 | Lewis et al. |
| 6,846,035 | B2 | 1/2005 | Wong et al. |

FOREIGN PATENT DOCUMENTS

| | | | |
|---|---|---|---|
| WO | WO 00/18673 | A1 | 4/2000 |
| WO | WO 02/072320 | A1 | 9/2002 |

* cited by examiner

FIG. 12
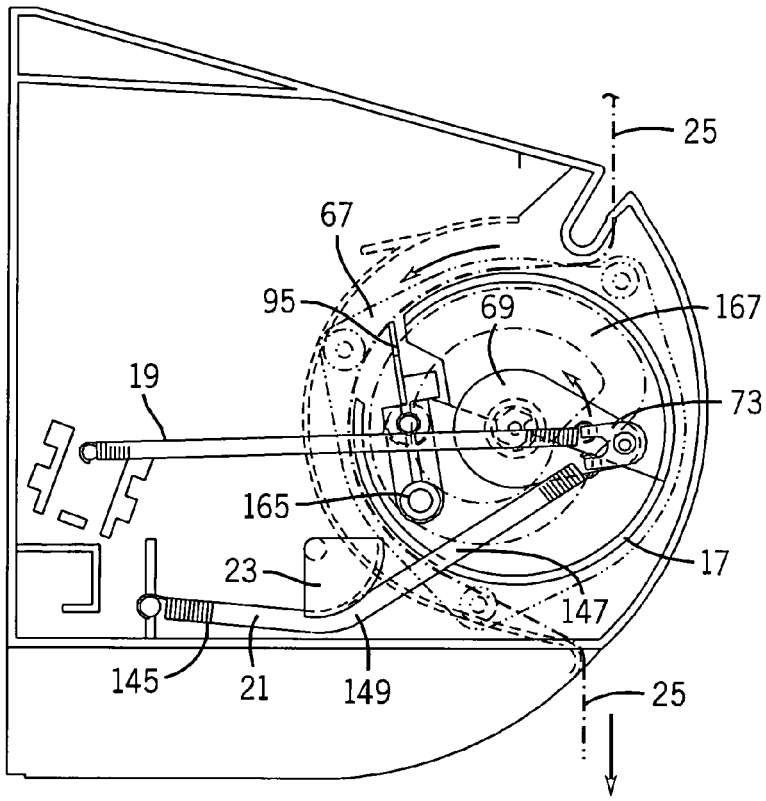
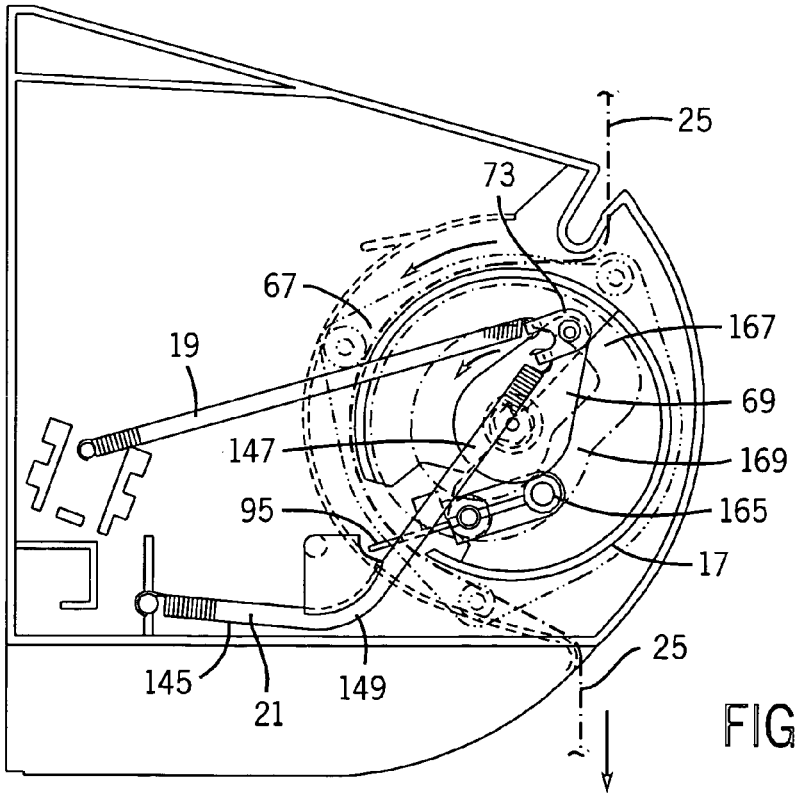
FIG. 13

FIG. 14
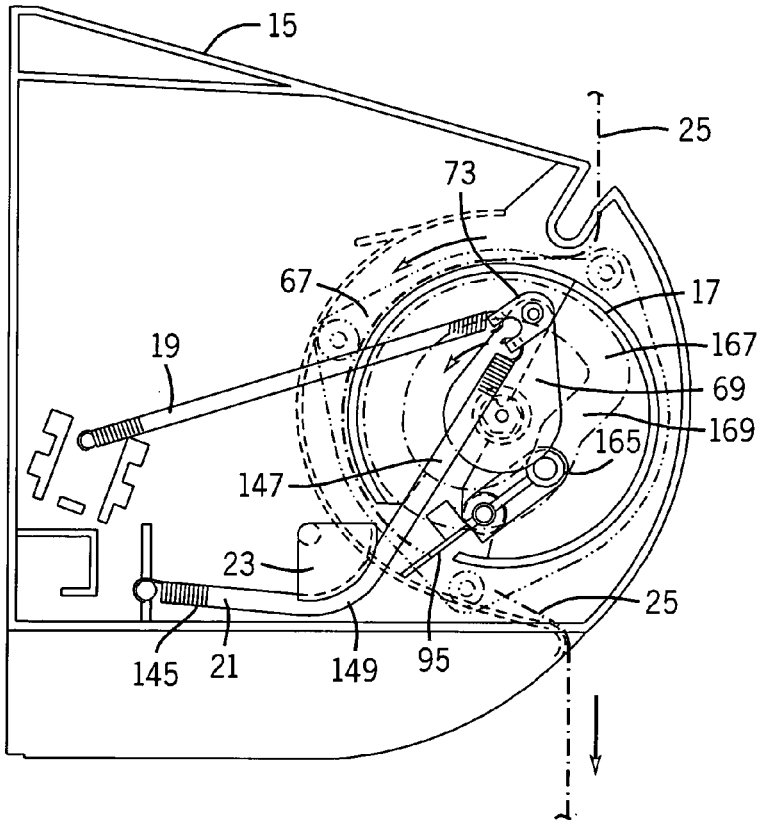
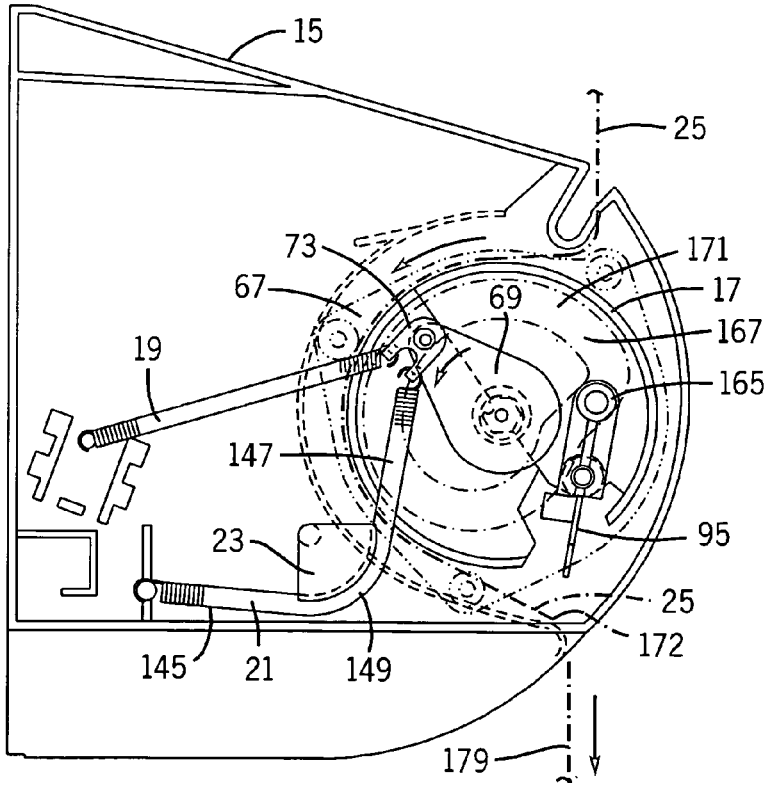
FIG. 15

DISPENSER APPARATUS WITH DRIVE MECHANISM

RELATED APPLICATION

This application claims the benefit of provisional U.S. patent application Ser. No. 60/681,241 filed May 13, 2005 the entire contents of which are incorporated herein by reference.

FIELD

The field relates to dispenser apparatus and, more particularly, to sheet material dispensers and drive mechanisms for use therewith.

BACKGROUND

Dispensers for flexible sheet material, such as paper towel, cloth towel, tissue and the like, are well known in the art. Certain types of sheet material dispensers are powered through some or all of a dispense cycle by a drive mechanism including one or more springs. For example, in a dispenser type known as a hands-free dispenser, a drive mechanism is utilized to discharge sheet material from the dispenser and to power a cutting mechanism which provides a single sheet of material to the user. More specifically, a dispense cycle is initiated when a user pulls on the sheet material tail which extends from the dispenser. Pulling of the tail initiates operation of the dispenser drive mechanism by rotating a dispenser drive roller and by energizing one or more springs associated with the drive roller. The spring or springs then power the drive roller to rotate through the dispense cycle and may further power the cutting mechanism to fully or partially sever the sheet material resulting in the user being provided with a single sheet of material.

Dispensers of the type described above must be robust and must be capable of dispensing a separate sheet of material to a user reliably over many dispense cycles. And, because space in a washroom or other intended dispenser location may be limited, the dispenser should include components enabling the dispenser to be manufactured with a compact housing.

SUMMARY

Apparatus and methods for dispensing sheet material from a sheet material dispenser are described. In preferred embodiments, the apparatus comprises a housing and a drive mechanism for discharging sheet material from the dispenser. Preferably, the drive mechanism comprises a drive roller rotatably mounted with respect to the housing and at least one spring powering rotational displacement of the drive roller during at least a portion of a drive roller rotational cycle.

The drive mechanism includes diverter apparatus adapted to bend at least one of the springs along at least one spring position, preferably intermediate the spring ends. Such diverter apparatus enables use of one or more springs each having a length greater than that of a spring arranged in a traditional axial orientation. Elongation of each diverted spring enables each such spring to better power the drive mechanism in a more compact dispenser housing.

BRIEF DESCRIPTION OF THE DRAWINGS

The foregoing and other objects, features and advantages of the invention will be apparent from the following description of preferred embodiments, as illustrated in the accompanying drawings in which like reference characters refer to the same parts throughout the different views. The drawings are not necessarily to scale, emphasis instead being placed upon illustrating the principles of the invention. In the drawings:

FIGS. 10-15 are schematic side elevation views of the exemplary dispenser of FIGS. 1-9 showing the position of certain drive mechanism, cutting mechanism and other components during different stages of a dispense cycle. Certain parts are shown in phantom line or are omitted to facilitate understanding of the apparatus and methods of operation.

DETAILED DESCRIPTION

Figure 1:
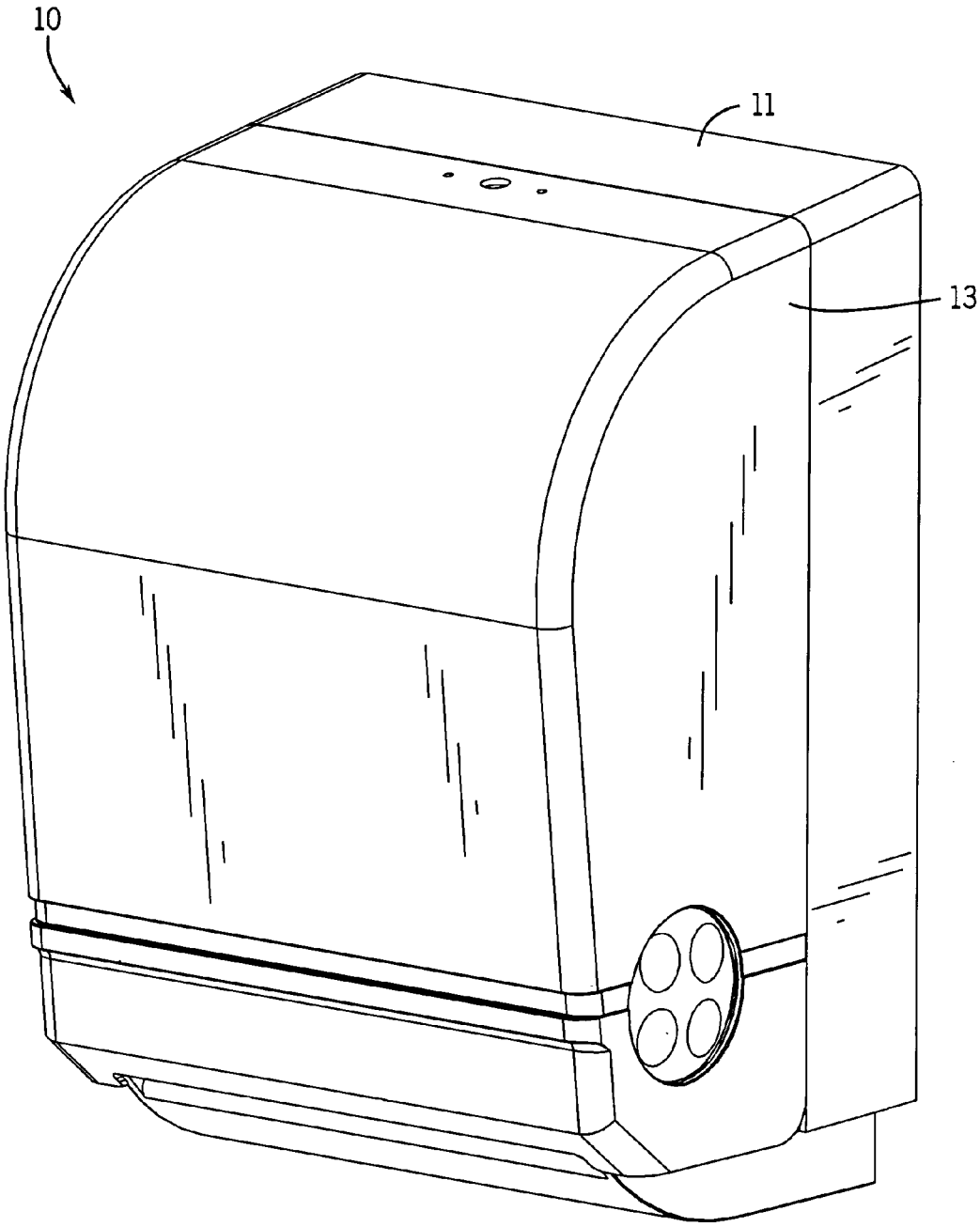
FIG. 1 is a perspective view of an exemplary dispenser.
Figure 2:
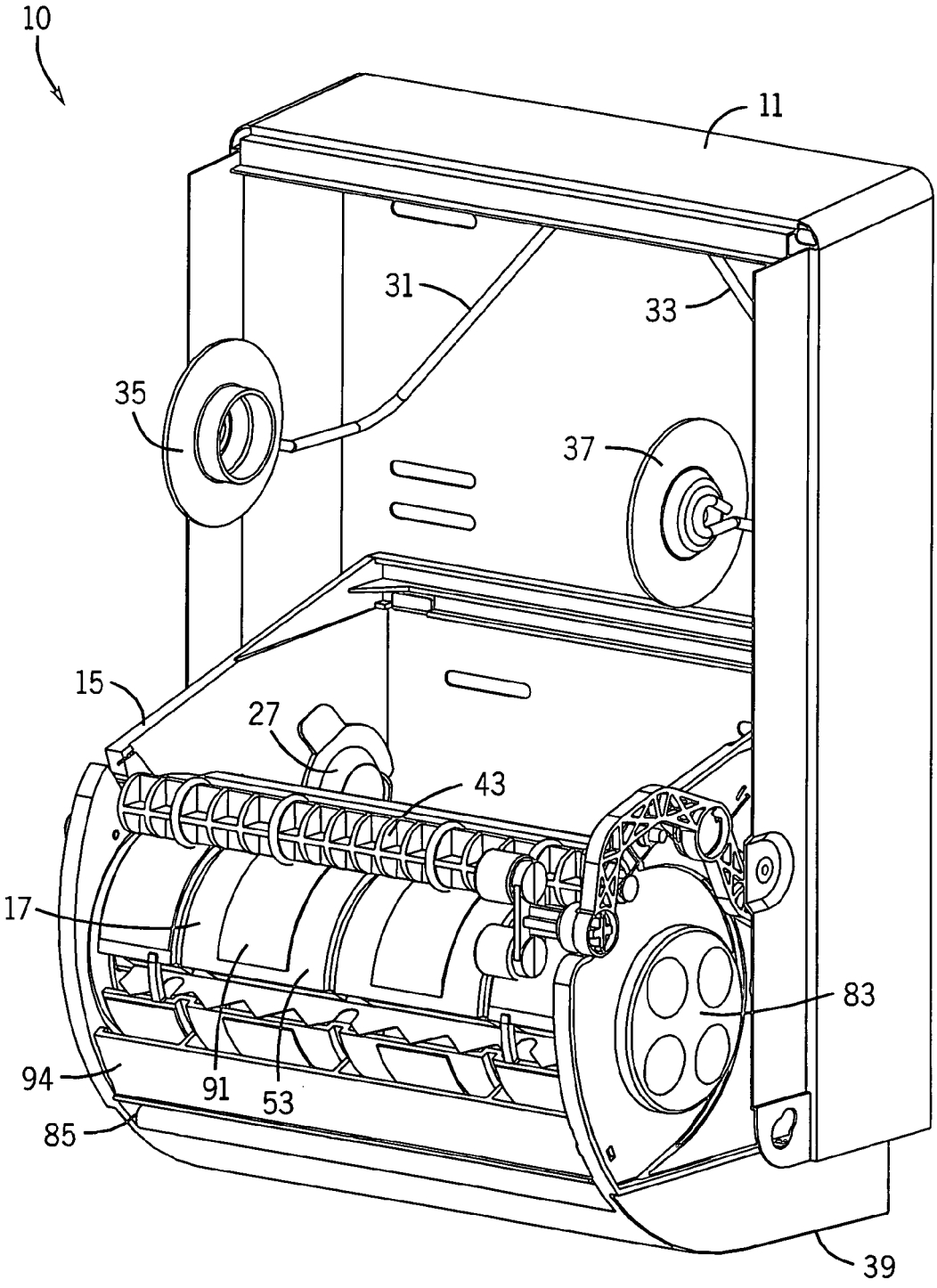
FIG. 2 is a perspective view of the dispenser of FIG. 1 with the front cover removed.
Figure 3:
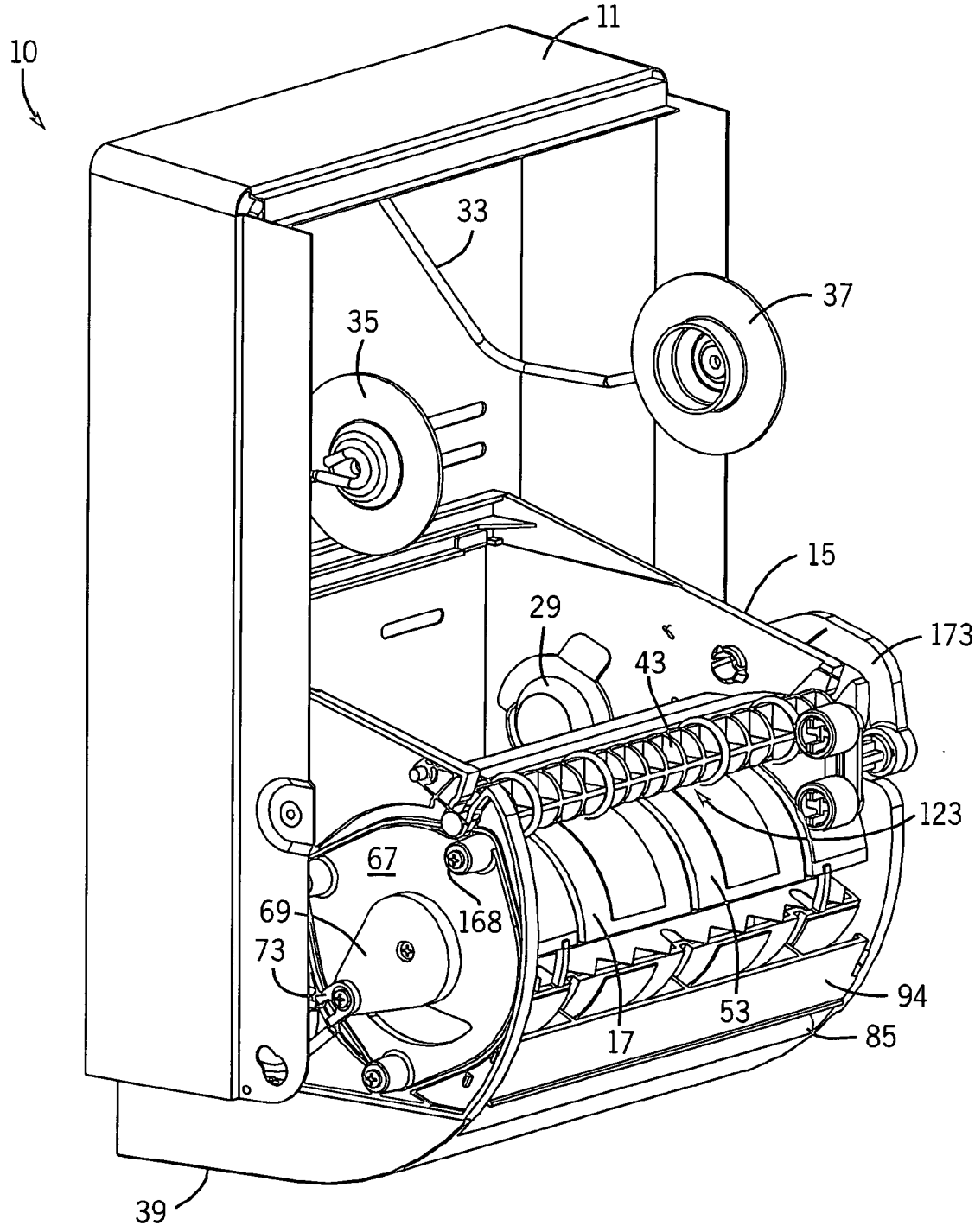
FIG. 3 is a further perspective view of the dispenser of FIG. 1 with the front cover removed.
Figure 4:
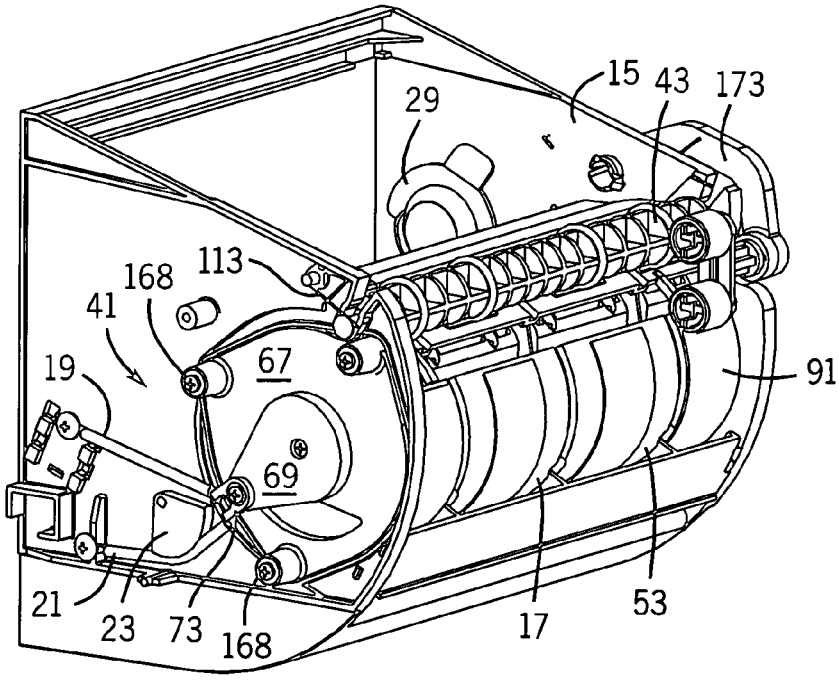
FIG. 4 is a perspective view of a dispenser frame removed from the dispenser.
Figure 5:
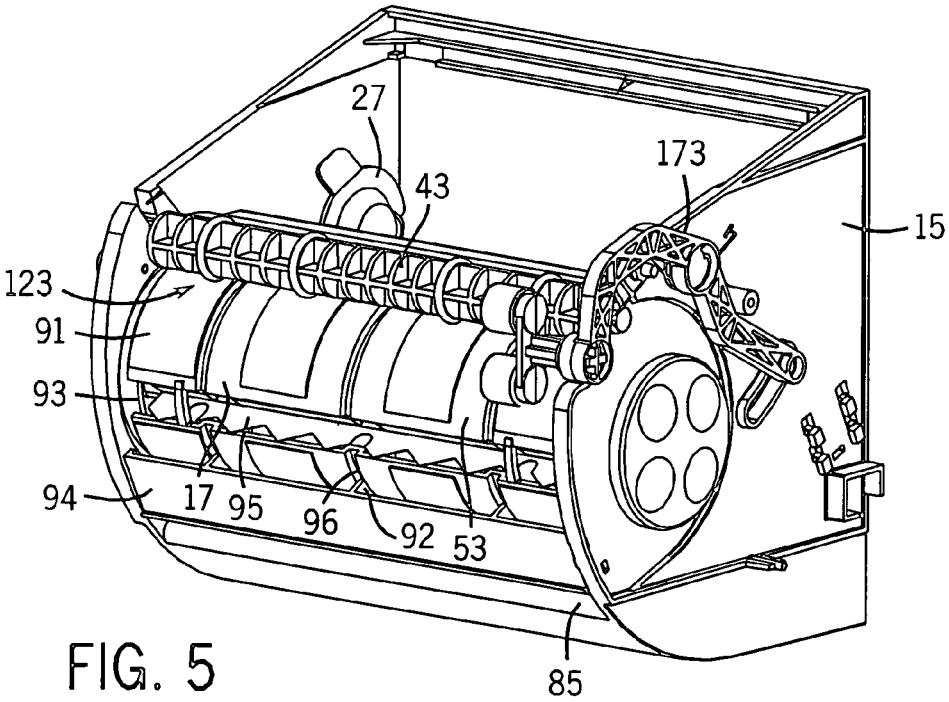
FIG. 5 is a further perspective view of the dispenser frame of FIG. 4.

The mechanical components comprising preferred embodiments of an exemplary dispenser 10 will first be described. Referring first to FIGS. 1-3, dispenser 10 preferably includes housing 11 and removable front cover 13. In the embodiment, dispenser 10 is configured for mounting on a vertical wall surface (not shown) permitting a user to easily access dispenser 10. Housing and cover 11, 13 may be made of any suitable material or materials such as formed sheet metal, plastic and the like.

Frame 15 is mounted within housing 11 as shown in FIGS. 2-3. Frame 15 may be a unitary part made of plastic or other suitable material and secured with respect to housing 11 in any suitable manner. Frame 15 supports drive roller 17, springs 19, 21 and diverter 23. Drive roller 17 may also be referred to by some in the industry as a "drum."

Preferably, dispenser 10 is adapted to dispense sheet material in the form of a sheet material roll (not shown). As is well known, sheet material in roll form comprises a hollow cylindrically-shaped tubular core (not shown) and sheet material in the form of a web 25 of sheet material (FIGS. 10-15) wrapped around the core. The core is typically a hollow tube made of cardboard, plastic or the like.

The dispenser shown can accommodate a stub roll (not shown) and a reserve roll (not shown) of the sheet material. The stub roll may be supported within frame 15 on stub roll holders 27, 29 mounted on frame 15. Each end of the tubular core of the stub roll is mounted on a respective roll holder 27, 29 with the respective roll holder inserted into the hollow core. Holders 27, 29 are preferably made of a resilient material so that they may be spread apart to receive the stub roll between them. The stub roll is free to rotate when mounted on holders 27, 29.

The reserve roll is supported by support arms 31, 33 and web roll support cups 35, 37 mounted on respective arms 31, 33. Each end of the tubular core of the reserve roll is mounted on a respective cup 35, 37 with the respective cup inserted into the hollow core. Arms 31, 33 are preferably made of a resilient material so that they may be spread apart to receive the reserve roll core between them.

As will be appreciated, any type of support structure may be utilized to support the stub and reserve rolls. For example, the stub roll may simply rest on bottom wall 39 of frame 15 without holders 27, 29. By way of further example, holders 27, 29 and support arms and cups 31, 33, 35, 37 could be replaced with a rod inserted through the hollow roll core. Such a rod may be supported at its ends by housing 11.

There is no particular requirement with respect to the number of sheet material sources which may be dispensed from dispenser 10. Dispenser 10 could dispense, for example, from single or plural rolls of material depending on the intended use of dispenser 10.

A drive mechanism 41 is provided for discharging web 25 from dispenser 10. Drive mechanism 41 comprises drive roller 17, tension roller 43, tension springs 19, 21, diverter 23 and the related components as hereinafter described and as shown particularly in FIGS. 2-15.

Figure 6:
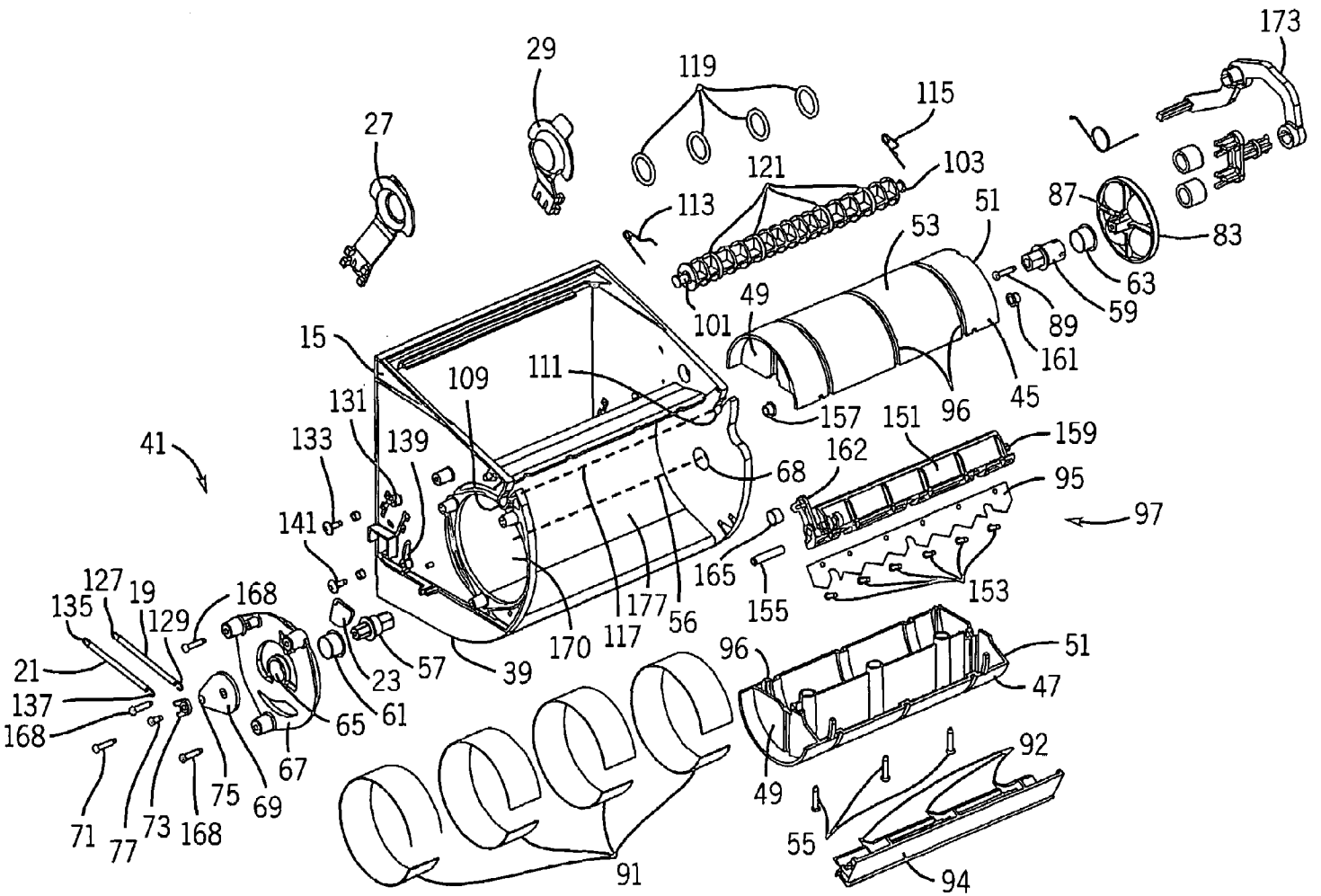
FIG. 6 is an exploded view of the dispenser frame and other dispenser parts.

Preferred drive roller 17 may be a drum-shaped member which is generally-cylindrical in appearance. Drive roller 17 may comprise first and second sections 45, 47, first and second ends 49, 51 and outer surface 53. Sections 45, 47 may be made of plastic or any other suitable material and may be joined by use of adhesives or fasteners 55 (FIG. 6).

Drive roller 17 is preferably mounted on frame 15 along axis 56. Drive roller 17 is preferably mounted for bidirectional rotatable movement by stub shafts 57, 59 which extend axially outward from a respective drive roller end 49, 51. Stub shafts 57, 59 are received in a respective bearing 61, 63. Bearing 61 is seated in opening 65 of cam 67 and bearing 63 is seated in opening 68 of frame 15. Bearings 61, 63 are preferably made of nylon or a similar low-friction material.

Referring to FIGS. 3-4, 6, and 10-15, eccentric arm 69 is seated on stub shaft 57 and is secured to stub shaft by fastener 71. Arm 69 co-rotates with drive roller 17. A spring-attachment member 73 is rotatably mounted to end 75 of arm 69 by fastener 77. Member 73 includes arms 79, 81 for attachment to a respective spring 19, 21 as described herein.

Referring to FIGS. 1-2 and 5-6, a hand wheel 83 linked to drive roller 17 may optionally be provided. Hand wheel 83 is provided to permit manual rotation of drive roller 17, such as to feed web 25 out from dispenser 10 through discharge opening 85 at the time web 25 is loaded into dispenser 10. Hand wheel 83 is linked to drive roller 17 at end 51 by means of a hand wheel post 87 keyed to fit into corresponding female opening (not shown) in stub shaft 59 and secured by fastener 89.

As shown in FIGS. 2-8, drive roller outer surface 53 preferably includes one or more friction surfaces 91 for engaging and gripping web 25. Friction surfaces 91 are provided to ensure that the drive roller outer surface 53 has sufficient frictional contact with the web 25 so that drive roller 17 will rotate as web 25 positioned across drive roller 17 is pulled from dispenser 10 by a user.

The plural friction surfaces 91 (FIGS. 2-6) may be in the form of sheet-like strips adhered to drive roller outer surface 53 with a suitable adhesive (not shown). However, such friction surfaces 91 could be provided in other manners, such as by forming such friction surfaces directly in outer surface 53. Further, the friction surfaces 91 need not be limited to the plural strip-like material shown and could comprise any appropriate configuration, such as a single sheet of material (not shown). Friction surfaces 91 may consist of any suitable high-friction material, such as grit or rubberized material. An over molded thermoplastic elastomer may also be applied to drive roller 17 out surface 53. Such an elastomer is applied directly to the surface 53 and sets to form a gripping surface similar to friction surfaces 91.

Fingers 92 of guard 94 extend into corresponding annular grooves 96 in drive roller 17 to separate web 25 from drive roller 17 so that web 25 does not become adhered to the drive roller 17 (such as by static electricity) and to ensure that web 25 is properly directed out of dispenser 10 through discharge opening 85. Guard 94 may be attached across frame 15 by any suitable means well known in the art.

Drive roller 17 preferably further includes a longitudinal opening 93 through which a cutting blade 95 of a cutting mechanism 97 extends to perforate the web 25 as hereinafter described.

Tension roller 43 urges web 25 against outer surface 53 of drive roller 17. Tension roller 43 preferably is a generally cylindrically-shaped member having first and second axial stub ends 101, 103. Roller axial stub ends 101, 103 fit rotatably in respective slots 109, 111 provided in frame 15. As shown in FIGS. 3-6, torsion springs 113, 115 urge tension roller 43 against drive roller 17. Tension roller 43 is generally coextensive with drive roller 17 and is mounted along an axis 117 parallel to axis 56.

Tension roller 43 may be provided with annular gripping surfaces 119 seated in a respective annular seat 121 and positioned to abut a respective drive roller friction surface 91. Such gripping surfaces 119 are preferably made of a tactile material such as rubber, or the like.

Drive roller 17 and tension roller 43 form a nip 123 at the interface of drive roller 17 and tension roller 43. Web material 25 is drawn from a respective stub or reserve roll through nip 123, against outer surface 53 of drive roller 17 and out of dispenser via discharge opening 85 as described in detail below.

Drive mechanism 41 further includes springs 19, 21 and diverter 23. Each spring 19, 21 is preferably a tension spring. Each spring 19, 21 may be identical to each other, but this is not required. Springs 19, 21 are loaded, or energized, by rotation of drive roller 17 resulting from user web pulling. Loaded springs 19, 21 then power further rotation of drive roller 17 and operation of the cutting mechanism 97 (as the springs are unloaded) to complete a dispense cycle.

As is well illustrated in FIGS. 3-5, 6, 10, 10A-10C and 11-15, spring 19 has ends 127, 129. End 127 is secured to frame 15 at post 131 and may be secured to post 131 by fastener 133. The other spring 19 end 129 is attached to arm 79 of spring-attachment member 73. Spring 21 had ends 135, 137. Spring end 135 is secured to frame 15 at post 139 and may be secured to post 139 by fastener 141. The second spring 21 end 137 is attached to arm 81 of spring-attachment member 73.

Figure 10:
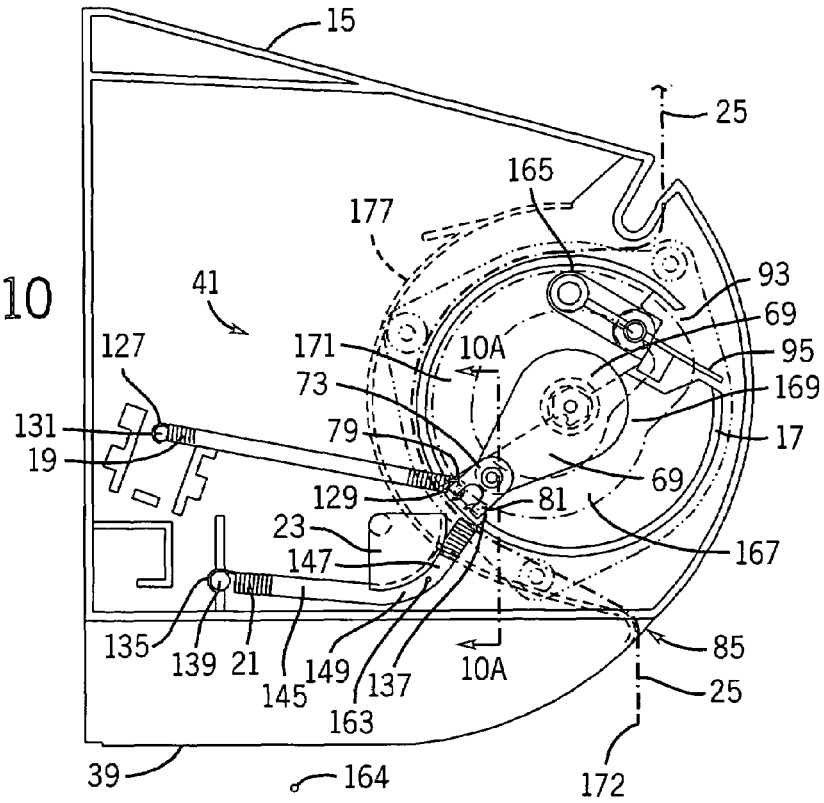
Figure 10A:
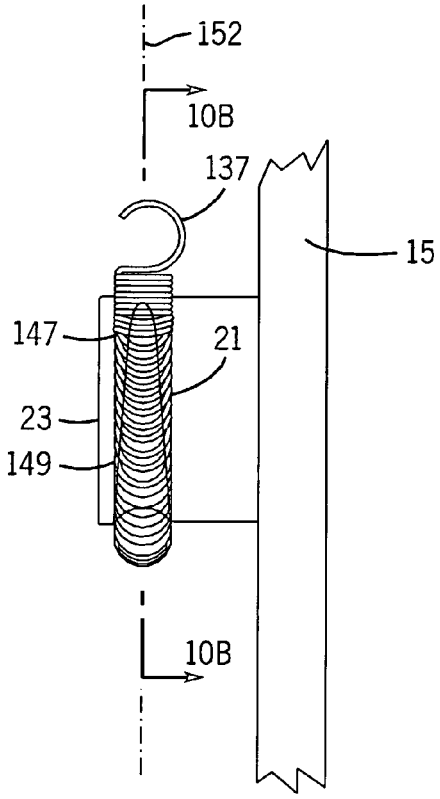
FIG. 10A is a partial sectional view taken along section lines 10A-10A of FIG. 10 showing portions of a diverter and spring.
Figure 10C:
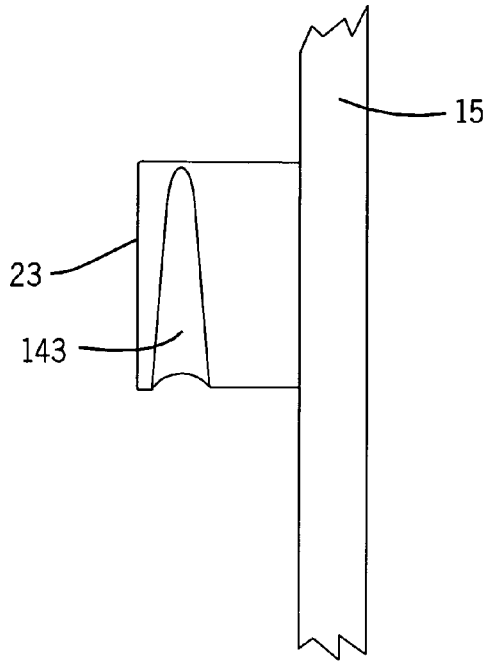
FIG. 10C is the partial sectional view of FIG. 10A but showing only portions of the diverter and frame.
Figure 10B:
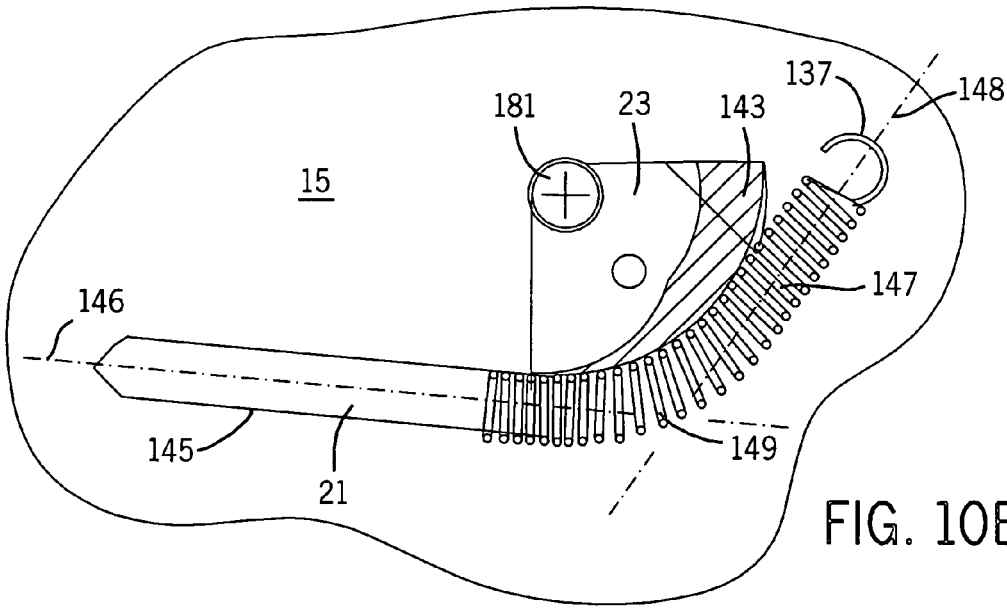
FIG. 10B is a partial side sectional view taken along section lines 10B-10B of FIG. 10A showing portions of a diverter and spring.

Referring further to FIGS. 3-5, 6, 10, 10A-10C and 11-15, diverter 23 is provided to contact spring 21 and to bend spring 21 when spring 21 is in the rest position of FIG. 10. Preferably, diverter 23 contacts spring 21 between ends 135, 137. Diverter 23 is secured to frame 15 by adhesive or other suitable fastener 181 (FIG. 10B). Referring again to FIGS. 10, 10A-10C and 11-15, diverter 23 may include a guide surface 143. Guide surface 143 preferably includes a groove, or recess, in which spring 21 is fully or partially seated when in the rest position of FIG. 10. Guide surface 143 groove serves as a guide to keep spring 21 in place during the dispense cycle. Diverter 23 may be made of materials such as plastics. Diverter 23 could be an integral component of frame 15.

In the preferred rest position of FIG. 10, spring 19 has a generally axial orientation which is retained generally throughout a dispense cycle. Spring 21 has a generally axial segment 145 between end 135 and diverter 23 and a generally axial segment 147 between diverter 23 and end 137. Axes 146, 148 are shown on FIG. 10B. Spring 21 has a segment 149 therebetween which is bent as it contacts diverter 23. Segments 145, 147 are axial only in the sense that they represent generally straight spring portions about diverter 23 when at rest as in FIG. 10. Put another way, spring 21 is bent by the diverter. The bend preferably includes a radius as shown in FIGS. 4, 10A, 10B and 10-15. The position and orientation of segment 147, in particular, will change as spring 21 bends and is moved during a dispense cycle as is well-illustrated in FIGS. 10-15. Thus, diverter 23 acts on spring 21 such that segments 145, 147 are not co-axial when in the rest position of FIG. 10. It is preferred but not required that springs 19, 21 are essentially co-planar along plane 146. By way of further example, spring 21 segment 147 could be arranged such that it lies outside of plane 146 in which springs 19, 21 are arranged (FIG. 10).

Diverter 23 advantageously permits use of a spring 21 which may be identical to spring 19, particularly in length and spring force. And, diverter 23 enables this result in a housing 11 which is more compact than if diverter 23 were not present. More specifically, if diverter 23 were not present, it would be necessary to use a spring which would be relatively shorter than spring 21 with the spring end 135 secured to frame 15 at a location proximate the point where diverter 23 contacts spring 21 in FIG. 10. Such a point is identified by reference number 163 in FIG. 10.

It is desirable, however, that the spring selected for use as spring 21 is a relatively longer spring because the relative extension of such a longer spring is less than that of a relatively shorter spring. As a result, the spring rate of the longer spring is more moderate and consistent throughout the full range of spring movement than that of a relatively shorter spring having a relatively more rapid rebound and more powerful spring force. Use of a relatively longer spring 21, therefore, desirably provides for more consistent and smooth operation of drive roller 17. A relatively shorter spring may be more likely to fail because of the tensile forces applied to it thereby requiring the use of more costly high tensile springs. Use of a relatively longer spring provides the manufacturer with the option to use springs made with less costly materials thereby minimizing cost while extending service life of the dispenser.

While a relatively longer spring 21 could be used in dispenser 10 without a diverter 23, such spring 21 end 135 would be required to be mounted below bottom wall 39 of frame 15 (at approximately point 164) to power rotational displacement of drive roller 17 in the same manner as shown in FIGS. 10-15. A larger housing 11 would be required to accommodate this mounting location and such a larger housing 11 may be unacceptable for some applications where space is at a premium or a more compact housing 11 and dispenser 10 appearance is desired.

Figure 7:
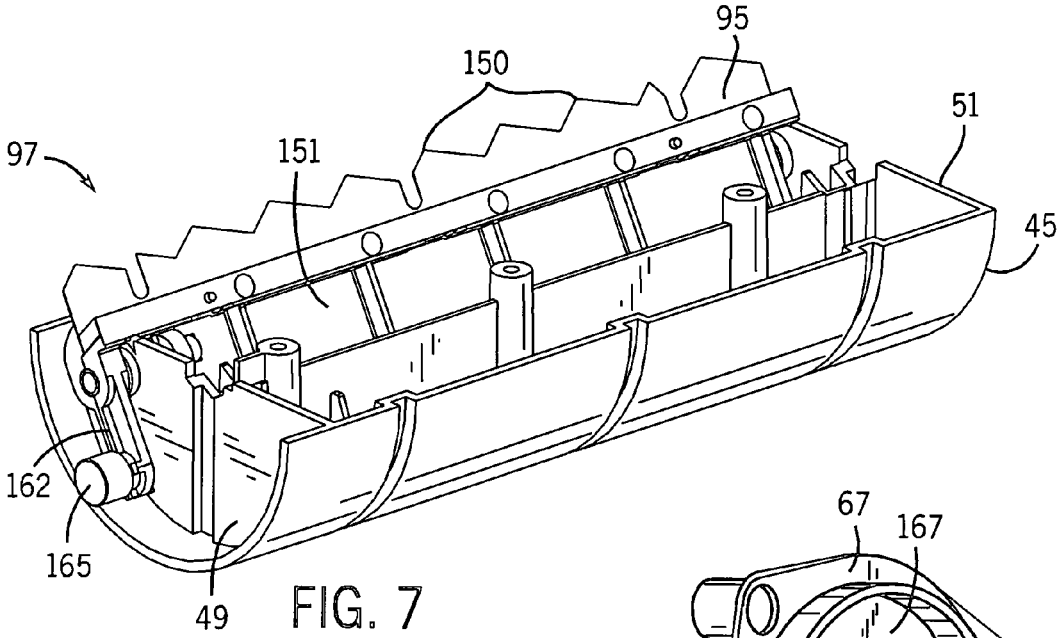
FIG. 7 is a perspective view of a drive roller portion.
Figure 9:
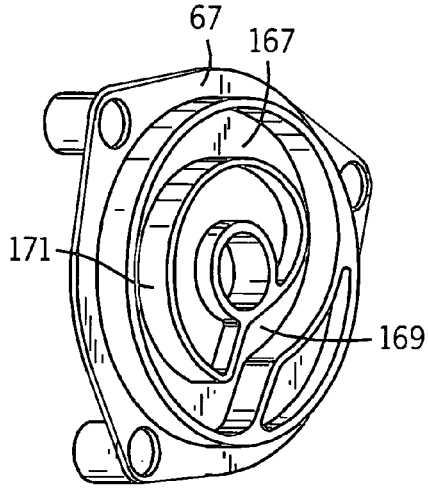
FIG. 9 is a perspective view of a cam.
Figure 8:
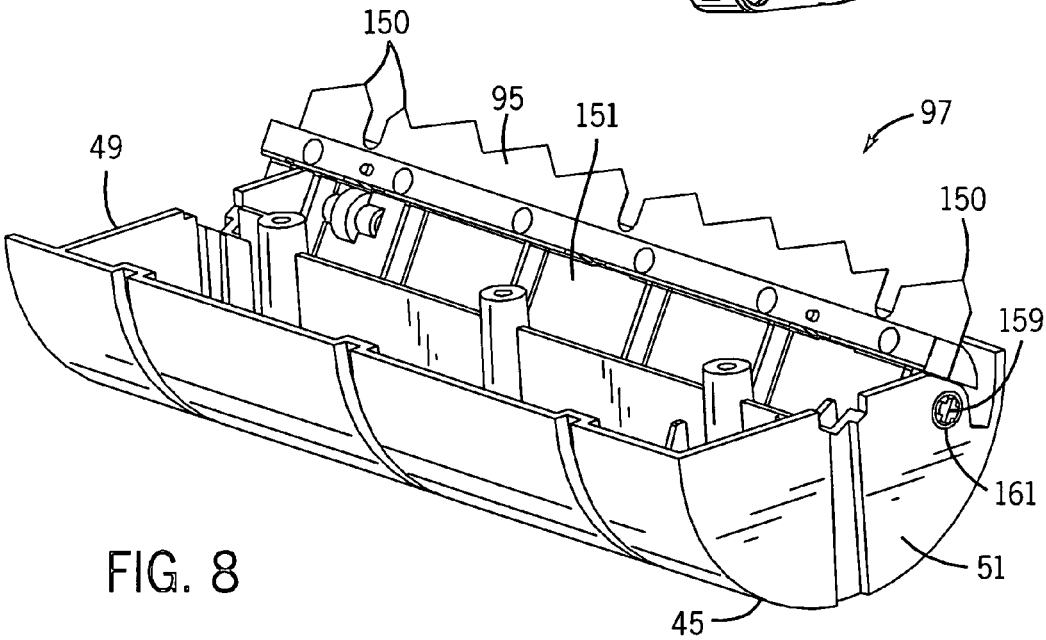
FIG. 8 is a further perspective view of the drive roller portion of FIG. 7.

Referring to FIGS. 2-15, a preferred cutting mechanism 97 for cutting web 25 is illustrated. The cutting mechanism 97 is preferably provided to cut fully through web 25 positioned against drive roller 17 outer surface 53 as drive roller 17 rotates under the force applied by user web pulling and springs 19, 21. The exemplary cutting mechanism 97 comprises blade 95, blade carrier 151, arm 162, follower 165, cam 67 and the related components. As shown in FIGS. 6-8, blade 95 may be provided with serrated teeth 150 secured to blade carrier 151 by fasteners 153. Blade carrier 151 is pivotally mounted to respective ends 49, 51 of drive roller section 45 by means of pin 155 seated in bearing 157 and stub shaft 159 seated in bearing 161. Bearings 157, 161 are seated in respective drive roller ends 49, 51. Pivoting action of carrier 151 enables blade 95 to extend outward from drive roller 17 to cut web 25 and further enables blade 95 to retract inward to drive roller 17 following cutting. In the embodiment, serrated teeth 150 cut completely through web 25 so that a single sheet 179 of web 25 is provided during user web pulling.

Arm 69 is attached at one end to blade carrier 151 and supports rotatable cam follower 165 at its other end. Arm 69 and cam follower 165 are positioned for mounting outside of first drive roller section 45 end 49 so that cam follower 165 may be positioned in cam track 167 of stationary cam 67 as is well shown in FIGS. 9 and 10-15.

FIGS. 6, 9 and 10-15 illustrate exemplary cam 67. Cam 67 is preferably mounted to frame 15 with fasteners 168 so that cam track 167 extends through frame opening 170 and faces drive roller 17 and cam follower 165. Cam track 167 provided in cam 67 includes inwardly arcuate portion 169 and outwardly arcuate portion 171. Cam follower 165 follows cam track 167 as the drive roller 17 rotates during a dispense cycle. Cam track 167 is eccentric relative to stub shaft 57 and axis 56 and is structured and arranged such that the action of cam track 167 on cam follower 165 and arm 162, urges carrier 151 to pivot such that blade 95 extends to cut web 25 and retracts during each revolution of drive roller 17 as described more fully below.

Tail 172 of web 25 of the reserve roll may be manually loaded into nip 123 when the stub roll is fully depleted. Alternatively, an automatic transfer mechanism may be incorporated into dispenser 10 to automatically transfer tail 172 of web 25 of reserve roll to the nip 123 when the stub roll is fully depleted or very near full depletion., Such an automatic transfer mechanism is the subject of commonly owned U.S. Pat. No. 6,460,798, the entire contents of which are incorporated herein by reference. To provide a frame of reference for location of transfer mechanism, a transfer arm 173 as described in U.S. Pat. No. 6,460,798 and which urges web 25 of reserve roll into nip 123 is shown in FIGS. 2-6. Other transfer mechanism structure is not shown.

Operation of exemplary dispenser 10 will now be described particularly with respect to FIGS. 10-15. It will be understood that FIGS. 10-15 illustrate representative positions of drive roller 17 and other dispenser 10 components during a dispense cycle. The operational description will center on drive mechanism 41 and cutting mechanism 97. Web 25 may be supplied by a single roll, a stub roll or a reserve roll. The reader is again referred to U.S. Pat. No. 6,460,798, incorporated herein by reference, for a description of the structure and operation of exemplary transfer mechanisms suitable for use in supplying web 25 to nip 123 upon depletion of the stub roll.

FIG. 10 represents dispenser 10 in a rest, or ready, position prior to commencement of a dispense cycle. Web 25 is positioned between drive roller 17 and tension roller 43 through nip 123. (Tension roller 43 is not shown in FIGS. 10-15.) To facilitate threading of web 25 into nip 123 during loading of web 25, drive roller 17 may be manually rotated in the direction of arrow 175 (i.e. counterclockwise in the example shown) by means of hand wheel 83. As drive roller 17 is rotated, friction surfaces 91 engage web 25 which is urged against such friction surfaces by tension roller 43 and, potentially, by the action of user web pulling. Web 25 is drawn through nip 123 as drive roller 17 rotates in the direction of arrow 175 and tension roller 43 rotates in the opposite direction.

After exiting nip 123, web 25 is guided toward discharge opening 84 by arcuate guide wall 177. Web 25 is positioned over a portion of drive roller 17 outer surface 53 friction surfaces 91. Pulling of web 25 by a user draws web 25 tightly across the portion of friction surfaces 91, as shown in FIGS. 10-15. Guard 94 fingers 92 extend into corresponding annular grooves 96 of drive roller 17 to separate web 25 from drive roller 17 to facilitate movement of web 25 out of dispenser 10 through discharge opening 85. Web tail 172 is then extended from discharge opening 85 by rotation of hand wheel 83 to an appropriate length for gripping by a user. Web 25 is now positioned for dispensing from dispenser 10.

In the rest, or ready, position of FIG. 10, springs 19, 21 are partially loaded, or energized, and springs 19, 21 bias drive roller 17 and arm 69 to the position shown in FIG. 10. At the beginning of a dispense cycle, blade 95 is preferably retracted within drive roller 17 also as shown in FIG. 10. Dispenser 10 is now ready for use.

Figure 11:
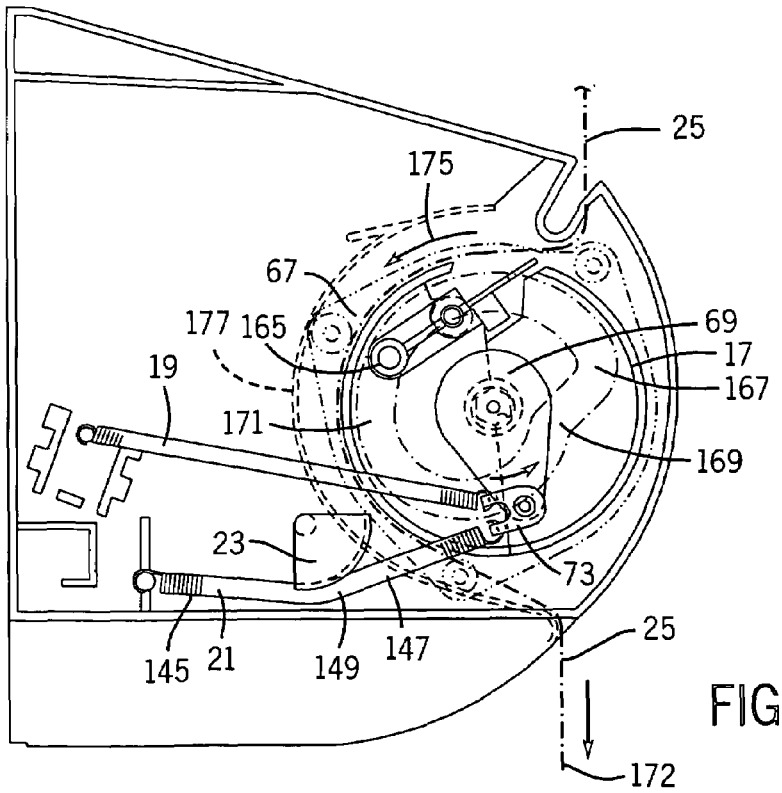

FIG. 11 represents dispenser 10 shortly after commencement of a dispense cycle. The dispense cycle is initiated by user web pulling of web 25 tail 172. The tension, or pulling, force of web 25 against drive roller 17 outer surface 53 friction surfaces 91 causes drive roller 17 to rotate in the direction of arrow 175. Springs 19, 21 are partially extended and are loaded (i.e., energized) as drive roller 17 rotates under the influence of web 25.

FIG. 12 represents a further position of dispenser 10 after commencement of a dispense cycle. Spring 19 is near fully extended and loaded (i.e., energized) at a centered position. Spring 21 is further partially extended and is being loaded (i.e., energized) as drive roller 17 rotates further under the influence of web 25. Blade 95 begins to move toward web 25 to perforate web 25 as cam 67 cam track 167 urges follower 165 and arm 162 to pivot blade carrier 151.

FIG. 13 represents yet a further position of dispenser 10 after commencement of a dispense cycle. Spring 19 is past the near centered position of FIG. 13 and powers rotation of drive roller 17 as the spring is unloaded by release of stored energy. Spring 21 segment 147 is now in approximately a centered position and spring 21 is fully loaded (i.e., energized) as shown. Spring 21 is just starting to power drive roller 17 rotation at this point in the dispense cycle. Blade 95 moves further toward web 25 to perforate the web as cam 67 cam track 167 urges follower 165 and arm 162 to pivot blade carrier 151. Spring 19 provides energy required to extend blade 95.

FIG. 14 represents yet another position of dispenser 10 after commencement of a dispense cycle. Springs 19, 21 are both past their centered positions and combine to power rotation of drive roller 17 as the springs are unloaded and stored energy is released. Blade 95 moves fully toward web 25 to completely cut web 25 as follower 165 enters inward portion 169 of cam track 167. Springs 19, 21 provide energy required to fully extend blade 95 to completely cut web 25. The result is a single sheet 179 of web 25 being provided to the user.

FIG. 15 illustrates a further position of dispenser 10 near completion of a dispense cycle. Springs 19, 21 are both past their centered positions and combine to power rotation of drive roller 17 as stored energy is released. Blade 95 begins to retract as follower 165 exits inward portion 169 of cam track 167. Spring 21 is the primary provider of energy required to retract blade 95 and return drive roller 17 to the resting position following web 25 cutting.

Finally, drive roller 17 is returned to the rest, or ready, position of FIG. 10. Tail 172 of web 25 is extended from discharge opening 85 and is ready to be grasped and pulled by a user. The dispenser 10 is now ready to initiate a new dispense cycle.

Dispenser 10 and its component parts may be made of any suitable material or combination of materials as stated above. Selection of the materials will be made based on many factors including, for example, specific purchaser requirements, price, aesthetics, the intended use of the dispenser and the environment in which the dispenser will be used.

While the principles of this invention have been described in connection with specific embodiments, it should be understood clearly that these descriptions are made only by way of example and are not intended to limit the scope of the invention.

What is claimed is:

1. Apparatus for dispensing sheet material comprising:

a housing;

a drive roller rotatably mounted with respect to the housing;

a spring powering rotational displacement of the drive roller during at least a portion of a drive roller rotational cycle; and a diverter adapted to bend the spring.

2. The apparatus of claim 1 wherein the spring has a first end secured with respect to the drive roller, a second end secured with respect to the housing and the diverter is adapted to bend the spring between the first and second ends.

3. The apparatus of claim 2 further comprising:

a drive roller rotational axis;

an arm secured with respect to a drive roller end for co-rotation with the drive roller, the arm extending radially outward from the axis and having an end; and the spring first end is secured with respect to the arm end.

4. The apparatus of claim 3 wherein the spring is a first spring and the apparatus further comprises a second spring for powering rotational displacement of the drive roller during at least a portion of the drive roller rotational cycle, the second spring comprising a first end secured with respect to the arm end and a second end secured with respect to the housing.

5. The apparatus of claim 4 wherein the first and second springs are substantially co-planar.

6. The apparatus of claim 5 wherein each spring has a length when de-energized and the lengths are substantially the same.

7. The apparatus of claim 2 wherein the diverter includes a guide surface in contact with the first spring.

8. The apparatus of claim 7 wherein the guide surface is curved.

9. The apparatus of claim 8 wherein the guide surface includes a recess adapted to receive the first spring.

10. A space-efficient paper towel dispenser comprising:

a housing defining a three-dimensional space;

support structure adapted to support a roll of paper towel for rotation within the housing;

a drive roller mounted with respect to the housing for rotational displacement during a dispense cycle, said drive roller being positioned for contact with paper towel unwound from the roll such that pulling of the paper towel by a user rotates the drive roller;

first and second springs adapted to power rotational displacement of the drive roller during at least a portion of the dispense cycle; and a diverter adapted to bend the first spring such that the housing has a minimized three-dimensional space.

11. The dispenser of claim 10 wherein the springs are tension springs.

12. The dispenser of claim 11 wherein each spring has a first end secured with respect to the drive roller and a second end secured with respect to the housing and the diverter is adapted to bend the first spring between the first and second ends.

13. The dispenser of claim 12 further comprising:

a drive roller rotational axis;

an arm secured with respect to a drive roller end for co-rotation with the drive roller, the arm extending radially outward from the axis and having an end; and the spring first ends are secured with respect to the arm end.

14. The dispenser of claim 13 wherein the springs are substantially co-planar.

15. The dispenser of claim 13 wherein the diverter includes a guide surface in contact with the first spring.

16. The dispenser of claim 15 wherein the guide surface is curved.

17. The dispenser of claim 16 wherein the guide surface includes a recess adapted to receive the first spring.

18. The dispenser of claim 10 further comprising a cutting mechanism operable to cut the paper towel responsive to drive roller rotation.

19. The dispenser of claim 18 wherein the cutting mechanism comprises:

a cutting blade carrier pivotably mounted with respect to the drive roller transverse to a direction of paper towel travel and pivotable between cutting and non-cutting positions;

a blade supported by the carrier;

a cam follower secured with respect to the carrier; and a stationary cam track receiving the cam follower, said cam track being configured such that the cam follower moves along the cam track during drive roller rotation and the cam track urges the carrier to move between the cutting and non-cutting positions during the dispense cycle.

20. In a paper towel dispenser comprising a housing defining a three-dimensional space, a drive roller rotatably mounted with respect to the housing and a cutting mechanism having a blade mounted with respect to the drive roller and movable between at least cutting and non-cutting positions responsive to drive roller rotation, a space-efficient drive mechanism for at least partially powering the drive roller and cutting mechanism comprising:

a pair of springs powering rotational displacement of the drive roller, each spring having one end secured with respect to the drive roller and a second end secured with respect to the housing; and a diverter positioned between the first and second ends of at least one spring such that the diverter bends the spring in a direction permitting reduction of the housing three-dimensional space.

21. The dispenser of claim 20 wherein the drive roller is mounted with respect to the housing in position to contact a paper towel web such that the drive roller rotates responsive to paper towel pulling by a user.

22. The dispenser of claim 21 wherein:

the springs are energized during paper towel pulling;

energy in the springs at least partially powers drive roller rotation; and the blade is powered between at least the cutting and non-cutting positions responsive to drive roller rotation.

23. The dispenser of claim 22 wherein each spring has a spring rate and a rate of spring rate change and the spring rate and rate of spring change are substantially similar.

24. The dispenser of claim 22 wherein the diverter includes a guide surface in contact with the at least one spring.

25. The dispenser of claim 24 wherein the guide surface is curved.

26. The dispenser of claim 25 wherein the guide surface includes a recess adapted to receive the at least one spring.

27. A method of dispensing a web of paper towel from a dispenser, said dispenser having a housing defining a three-dimensional enclosure, a drive roller mounted in the housing for rotational displacement responsive to pulling of the paper towel by a user and a cutting mechanism having a blade movable to a towel cutting position responsive to drive roller rotational displacement, the method comprising:

rotating the drive roller to initiate a rotational cycle;

energizing a spring by rotating the drive roller, said spring being secured with respect to the drive roller and housing and positioned and arranged such that the spring has segments that lie along plural axes;

powering drive roller rotation by de-energizing the spring during at least a portion of the rotational cycle;

cutting the paper towel with the cutting mechanism responsive to drive roller rotation; and braking drive roller rotation with the spring to complete the rotational cycle.

28. The method of claim 27 wherein rotating the drive roller to initiate a dispense cycle comprises pulling the paper towel from the dispenser.

29. The method of claim 27 wherein the spring is a first spring and the method further comprises energizing a second spring by rotating the drive roller, said second spring being secured with respect to the drive roller and housing.

30. The method of claim 29 wherein powering drive roller rotation further comprises powering drive roller rotation by de-energizing the first and second springs during at least a portion of the rotational cycle.

31. The method of claim 30 wherein cutting the paper towel with the cutting mechanism comprises extending the blade from the drive roller to the cutting position to cut the paper towel.

* * * * *